United States Patent [19]

Amdal

[11] 4,109,950

[45] Aug. 29, 1978

[54] DOOR OPENER AND LATCH

[75] Inventor: Dagfinn O. Amdal, Rockford, Ill.

[73] Assignee: Keystone Consolidated Industries, Inc., Peoria, Ill.

[21] Appl. No.: 763,827

[22] Filed: Jan. 31, 1977

[51] Int. Cl.[2] ..... E05C 13/00

[52] U.S. Cl. ..... 292/254; 292/DIG. 16; 292/DIG. 37; 292/DIG. 38; 292/DIG. 72

[58] Field of Search ..... 292/254, 87, DIG. 16, 292/DIG. 37, DIG. 72, DIG. 38, 128

[56] References Cited

U.S. PATENT DOCUMENTS

| | | | |
|---|---|---|---|
| 194,166 | 8/1877 | Newbrough | 292/254 |
| 651,464 | 6/1900 | Lint | 292/254 |
| 906,452 | 12/1908 | McCleer | 292/128 |
| 2,233,278 | 2/1941 | Aldeen | 292/DIG. 72 |
| 3,469,875 | 9/1969 | Ahlgren | 292/DIG. 38 |
| 3,797,870 | 3/1974 | Beckman | 292/228 |

*Primary Examiner*—Kenneth J. Dorner

*Attorney, Agent, or Firm*—Allegretti, Newitt, Witcoff & McAndrews

[57] ABSTRACT

An improved door opener and latch device particularly useful for cabinets in recreational vehicles includes a bolt attached to a cabinet door and engageable either with a strike housing attached to the frame for the door or with a control plunger member attached to the frame. A hidden control plunger in the frame releases the bolt from the strike.

6 Claims, 10 Drawing Figures

DOOR OPENER AND LATCH

BACKGROUND OF THE INVENTION

This invention relates to an improved door opener and latch device and, more particularly, to a door opener and latch device useful in combination with cabinets having panels which pivot about a horizontal axis.

With the increase in popularity of recreational vehicles, various accessories for such vehicles have come into demand. Among such accessories are interior storage cabinets. Typically, such storage cabinets include a front panel or door which is hinged along its top edge to swing from a vertical closed position outward and upward about a horizontal axis to an open position. When the panel is in the vertical closed position, it is desirable to have a latch mechanism which will retain the panel in the closed position. Such a latch mechanism should resist sudden jars or bumps which may occur in a recreational vehicle.

Additionally, such a latch mechanism is desirably concealed or semi-concealed so that hardware will not be exposed on the outside of the panel. That is, hardware may project dangerously into the interior of the vehicle and provide a source of injury or damage. Thus, for reasons of safety, it is desirable to maintain the latch mechanism as a concealed or semi-concealed mechanism.

Latch mechanisms of this general nature have been disclosed in prior art patents. For example, Beckman in U.S. Pat. No 3,797,870 discloses a flush mounted handle, latch bolt lock and housing assembly. The Beckman device may be flush mounted in a vertical door panel of a recreational vehicle in a manner that avoids dangerous exposure of the latch.

While the latch mechanism disclosed in the Beckman patent is sufficient and adequate for its intended purpose, a feature not provided by the Beckman device is a mechanism which, upon release thereof, partially opens the vertical door to form a gap between the door and the frame. The foregoing features and considerations are among those which inspired the development of the present invention.

DESCRIPTION OF THE PREFERRED EMBODIMENT

In a principal aspect, the present invention of an improved door opener, latch device includes a flexible bolt member which is affixed to a vertical door panel and which is cooperative with a strike housing attached to a frame for the door panel. A plunger member is reciprocally mounted in the housing and includes a portion which projects through the frame to the exterior. Manual actuation of the plunger against a spring biasing force causes the plunger to engage the flexible bolt. Movement of the plunger to a predetermined position releases the bolt from the strike and simultaneously forms a cam surface on which the bolt rides forcing the door panel to a partially open position. Subsequently, the panel may be manually moved to a desired open position.

Various alternative arrangements of the flexible bolt, strike housing and plunger are disclosed including an arrangement wherein the bolt is rigid and cooperates with a plunger member rather than a strike housing.

It is thus an object of the present invention to provide an improved door opener and latch device, particularly useful for recreational vehicles and other applications wherein a hinged door panel cooperates with a frame.

Another object of the present invention is to provide a concealed or semi-concealed door opener and latch construction.

A further object of the present invention is to provide a door opener and latch construction which includes three separate parts that may be easily and quickly attached to a door frame and panel for coaction therewith.

Still a further object of the present invention is to provide a door opener and latch device which is economical to manufacture and easy to install.

These and other objects, advantages and features of the invention will be set forth in the detailed description which follows.

BRIEF DESCRIPTION OF THE DRAWING

In the detaled description which follows, reference will be made to the drawing comprised of the following figures.

DESCRIPTION OF THE PREFERRED EMBODIMENTS

Figure 5:
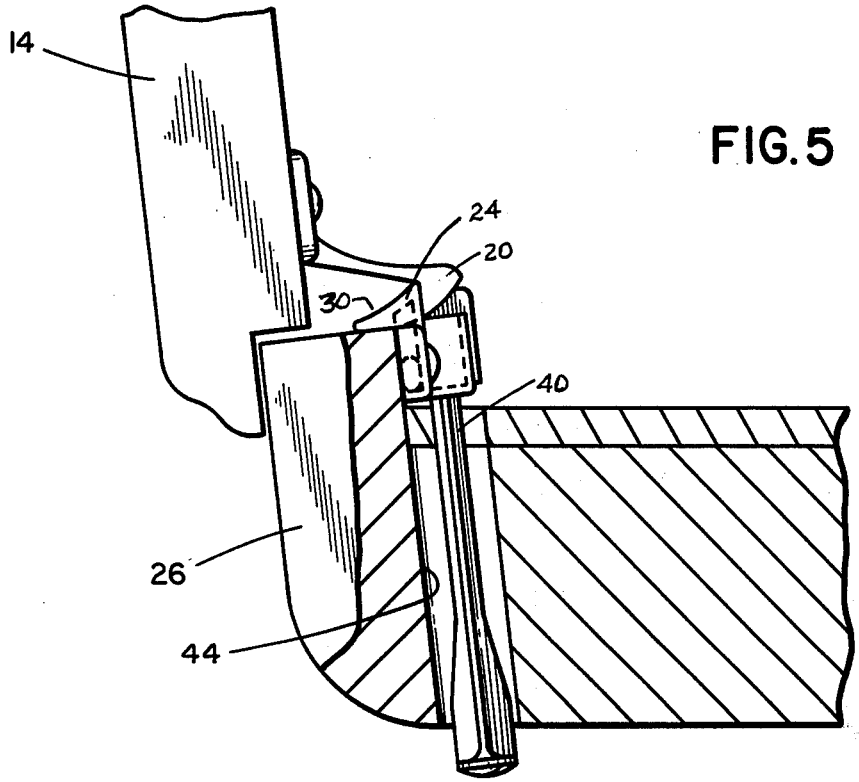
FIG. 5 is a side view illustrating a second embodiment of the improved door opener and latch device with the door panel in the closed or unlatched position.
Figure 7:
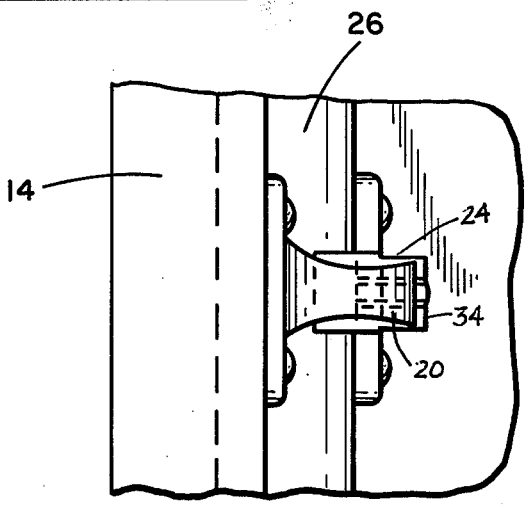
FIG. 7 is an end view of the opener shown in FIG. 5.
Figure 6:
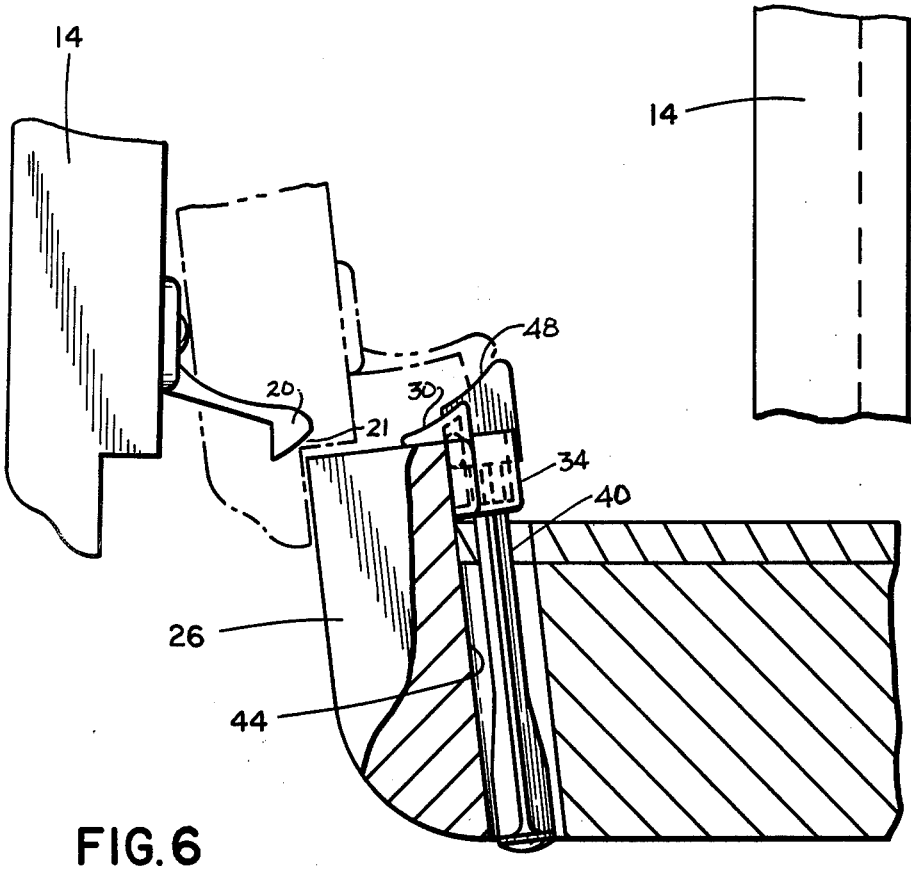
FIG. 6 is a side view similar to FIG. 5 wherein the door panel has been displaced to the unlatched or open position by operation of the plunger.
Figure 8:
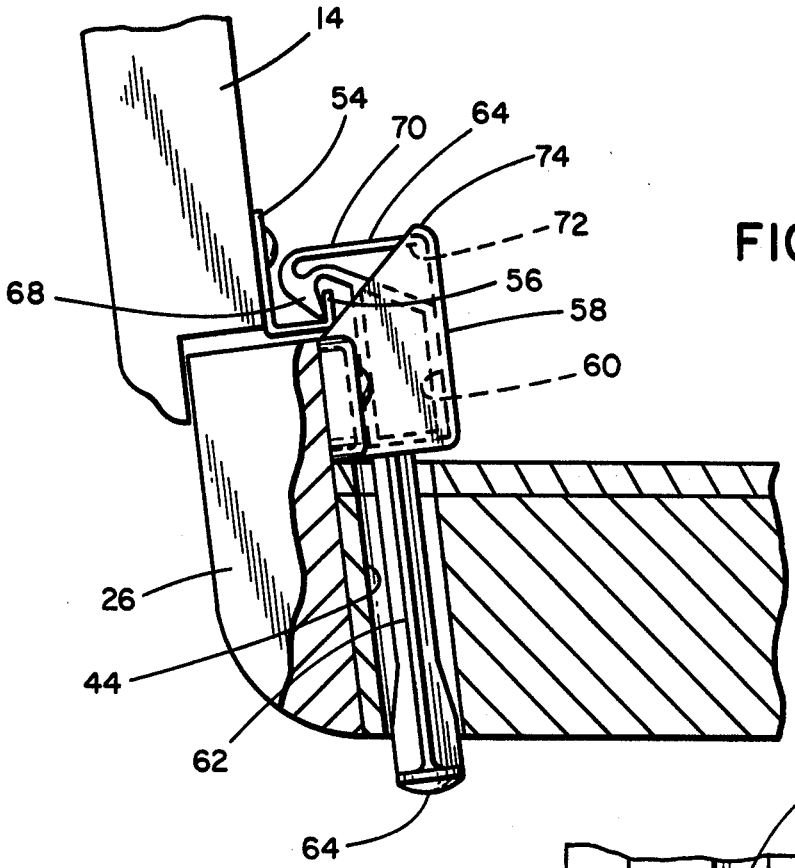
FIG. 8 is a side view of a third embodiment of the improved door opener and latch device of the present invention in the closed or latched position.
Figure 9:
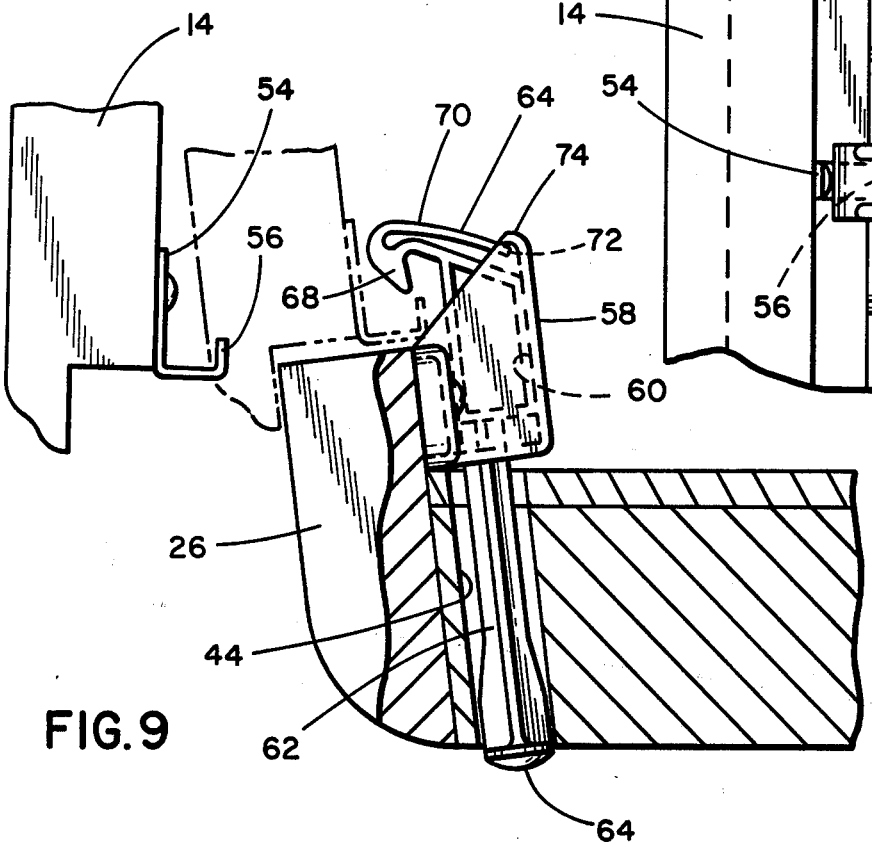
FIG. 9 is a side view similar to FIG. 8 wherein the latch device has been positioned in the unlatched or open position.
Figure 10:
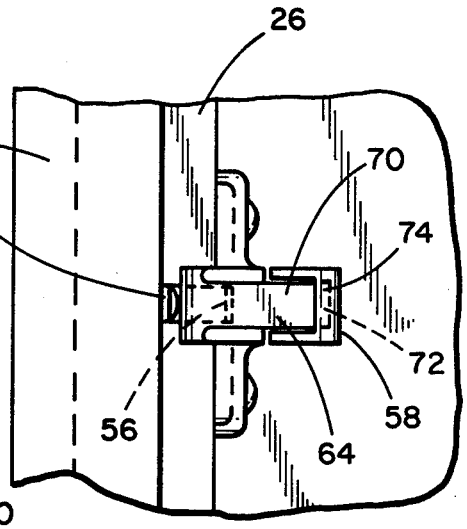
FIG. 10 is a top plan view of the door opener of FIG. 8.

Three embodiments are disclosed. FIGS. 1 through 4 illustrate the first embodiment. FIGS. 5 through 7 illustrate the second embodiment and FIGS. 8 through 10 illustrate the third embodiment. The two embodiments of FIGS. 1 through 7 serve as a latch device and, in addition, provide a means for positively moving the door panel to a partially open position when the latch device is unlatched. The embodiment of FIGS. 8–10 does not include a mechanism for driving the door panel to a partially open position when the latch is moved to the unlatched position.

Referring to FIGS. 1–4, the first embodiment includes a bolt assembly 12 attached adjacent the lower edge of a vertical door panel 14. Panel 14 is hinged along its top, horizontal edge (not shown) so that the panel will swing about a horizontal axis in the direction indicated by the arrow in FIG. 3.

Figure 4:
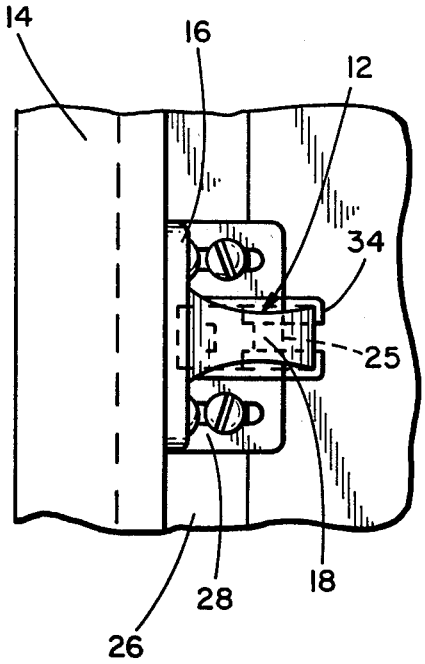
FIG. 4 is an end view of the door opener and latch device shown in FIG. 1.

The bolt assembly 12 includes an attachment plate 16 which as shown in FIG. 4 is screwed to the door panel 14. A first flexible arm 18 projects substantially perpendicular from the plate 16 and terminates with a hooked end 20. A second arm 22 extends from the first arm 18 and is substantially transverse thereto. The entire bolt assembly 12 is fabricated from a flexible plastic material such as Delrin or the like.

A housing 24 is fastened to frame 26. Housing 24 is also preferably fabricated from a plastic material such as Delrin or the like. Housing 24 includes a lower plate member 28 which is fastened to frame 26 so that an inclined cam surface 30 is opposed to panel 14. Surface 30 smoothly interfaces with vertical front surface 32 of housing 24. Opposite the front surface 32 is a back retainer guide 34 which cooperates with a plunger 40 as described below. The housing 24 is hollowed out on its interior or includes a cavity 36 for cooperation with portions of a plunger 40.

Figure 1:
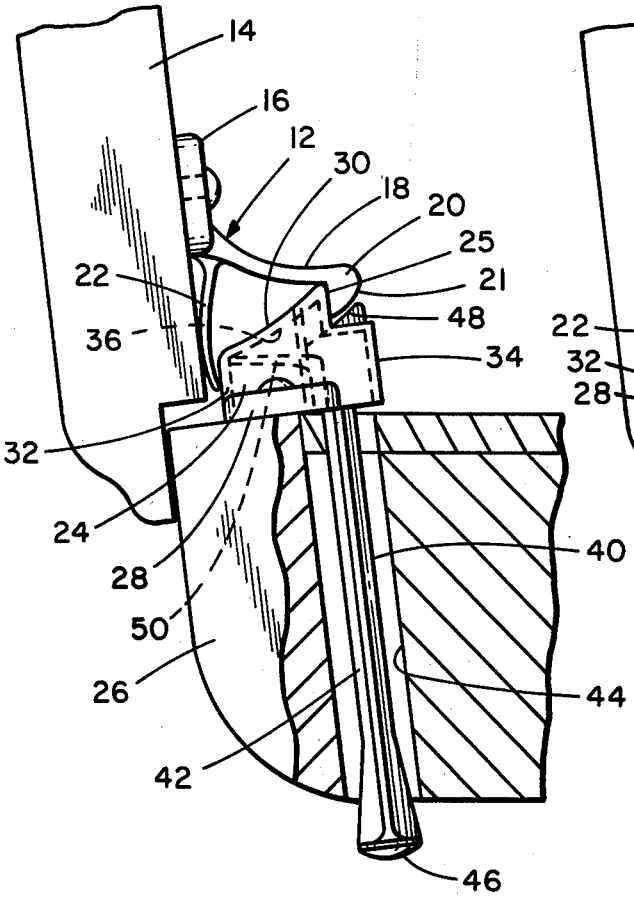
FIG. 1 is a side cross-sectional view of a first embodiment of the invention as installed in a frame and panel.
Figure 2:
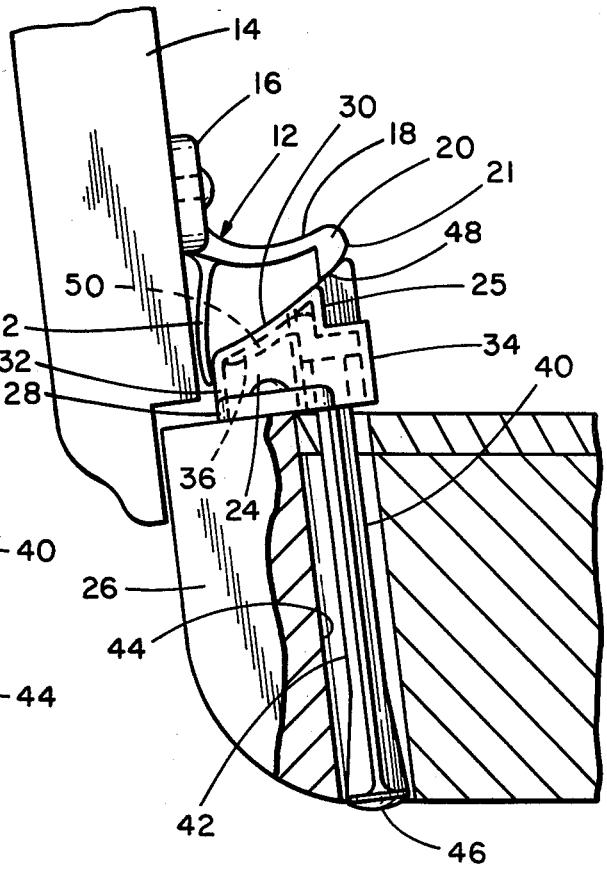
FIG. 2 is a side view of the embodiment shown in FIG. 1 wherein the bolt has been engaged by a plunger and moved to a nearly unlatched position.
Figure 3:
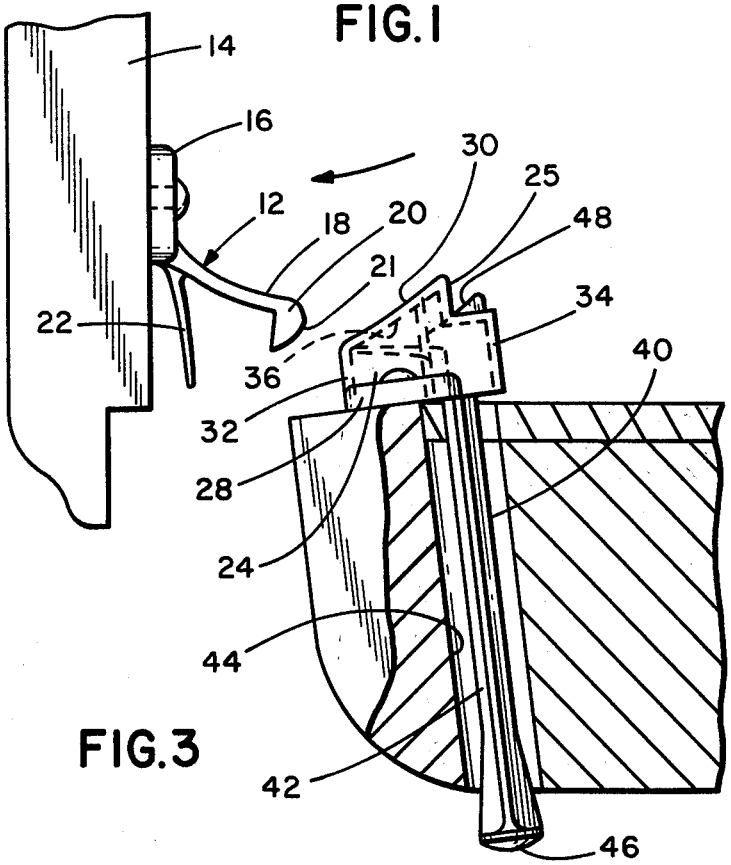
FIG. 3 illustrates the embodiment as depicted in FIG. 2 with the bolt moved to the open or unlatched position.

Plunger 40 includes an arm 42 which extends through a passage or bore 44 in frame 26. The arm 42 terminates with a push button 46 which is accessible from the outside of the frame 26. The opposite end of the plunger 40 includes a cam surface 48 mounted for reciprocal movement in the guide 34. A flexible projecting arm 50 extends opposite the cam surface 48 and engages the underside of cam surface 30 in cavity 36. Arm 50 is flexible and acts to bias the plunger 40 toward the extended or "out" position as illustrated in FIG. 1.

Manual actuation of the plunger 40 by manipulation of the push button 46 causes the plunger 40 to be translated against the force of the flexible biasing arm 50. Thereby cam surface 48 engages a cam follower surface 21 at the end 20 of first arm 18. In this manner, the hooked end 20 is transported toward the position illustrated in FIG. 2 against the biasing force of flexible arm 18.

Upon reaching a position of disengagement between the hooked end 20 and the locking strike surface 25 of housing 24, the cam follower surface slides against the continuous cam surface defined by the cam surface 48 and cam surface 30. In this manner the door panel 14 is forced toward the open position. This sliding action is initiated by forces associated with the flexible first arm 18. In addition, the second arm 22 provides biasing forces tending to draw the arm 18 along the cam surface 30, thereby forcing the door panel 14 toward the open position. Release of the push button 46 permits the plunger 40 to return to its original position shown in FIG. 1. The panel 14 remains in a partially open position for manual movement to a desired open position or for subsequent closing.

Closing is effected by pushing the panel 14 toward the closed position. When doing this, the cam follower surface 21 rides up on the cam surface 30 until the hooked end 20 engages with the strike surface 25.

Referring now to FIGS. 5–7, a second embodiment of the invention is illustrated. Like parts otherwise have like numbers assigned thereto for both the first and second embodiments.

In the second embodiment of the invention, flexible arm 22 has been eliminated. As illustrated, it has been found that flexible arm 22 need not necessarily be included in order to effect movement of the hooked end 20 and, in particular, the cam follower surface 21 along the cam surface 30 once the hooked end 20 is disengaged from the strike or housing 24 by operation of the plunger 40.

Additionally, it is noted with the embodiment of FIGS. 5–7, plunger 40 is not spring biased by a flexible arm 42. Rather, the plunger 40 is retained in a normal locked position as shown in FIG. 5 by means of gravity and the cooperation of the hooked end 20 with the cam surface 48.

The third embodiment, illustrated by FIGS. 8–10, is structurally different from the two other embodiments previously described. That is, a bolt 54 is fashioned from a metal plate in the shape of a hook to define a hooked end 56. The bolt 54 is appropriately fastened to the lower edge of panel 14 as illustrated in FIGS. 8–10.

A housing 58 attached to the frame 26 includes a cavity 60 adapted to receive the end of a plunger 62. The plunger 62 has a push button end 64 and a hooked end 66. The hooked end 66 includes a hook 68 for cooperative engagement with the hook 56 of the bolt 54.

A flexible arm 70 is attached to the head of the hooked end 66 of plunger 62. Arm 70 includes a free end 72 which engages an upper lip or flange 74 of housing 58. The arm 70 biases the plunger 62 within the cavity 60 to the extended or downward position. Thus, manual pressure against the push button 64 is required to translate the hooked end 68 out of engagement with the hooked end 56 of bolt 54.

Of course, it is possible to alter the interrelation of the various flexible arms with the plunger, strike housing and bolt to achieve substantially the same result. Thus, the invention is to be limited only by the following claims and their equivalents.

What is claimed is:

1. A door opener and latch device comprising, in combination:

a unitary, flexible latch bolt for attachment to a door panel, a strike for attachment to a frame, and a semi-concealed plunger member for mounting in the frame with the strike and for engaging and operating the bolt, said bolt including a first flexible arm projecting substantially transverse to the plane of the panel, said arm including a strike engaging projection biased in a first sense by the flexible arm into locking engagement with the strike when the panel is in a closed position on the frame, said strike being affixed to the frame to receive the projection, and said plunger including a first manual actuation end projecting on the outside of the frame and a second projection engaging portion on the inside of the frame, said plunger being mounted on the strike for reciprocal movement of the projection engaging portion into and out of engagement with the projection, said projection being disengaged from the strike by manual movement of the plunger to release the projection from the strike against the biasing force of the flexible arm by displacing the projecting from the strike, the biasing force of the flexible arm thereby providing a spring force which substantially simultaneously displaces the projection in the first sense from the strike and separates the panel from the frame, said plunger including a flexible biasing arm integrally molded with the plunger, said flexible biasing arm engaging the strike and continuously biasing the plunger toward the position out of engagement with the bolt.

2. The improved door opener and latch device of claim 1 wherein said strike includes an arcuate guide surface for engaging the latch bolt projection and guiding the latch bolt projection against the biasing force of the flexible arm into a locked position whereby the projection is engaged over a lip of the strike.

3. The door opener and latch device of claim 1 wherein said strike comprises a housing fixed to the frame, said housing including a guide slot for receipt and retention of the plunger member.

4. The door opener and latch device of claim 1 wherein said flexible latch bolt includes a second arm projecting substantially transversely from the first flexible arm and engageable against the strike when the door panel is in the closed position to impart a rotational force upon the first flexible arm in a sense opposite the force of the first arm.

5. The door opener construction of claim 1 wherein the plunger is substantially transverse to the arm and moves in a direction substantially parallel to the panel to engage the arm and drive the arm out of locking engagement with the strike.

6. The improved door opener construction of claim 1 wherein said plunger includes a driving cam surface for engaging the strike engaging projection and defines, in combination with the strike housing, an inclined surface upon which the strike engaging projection of the flexible arm moves in response to the biasing force of the arm whenever the plunger is moved to a position which effects release of the projection from the strike.

* * * * *